United States Patent [19]

Meijer et al.

[11] Patent Number: 4,632,179

[45] Date of Patent: Dec. 30, 1986

[54] HEAT PIPE

[75] Inventors: Roelf J. Meijer; Benjamin Ziph, both of Ann Arbor, Mich.

[73] Assignee: Stirling Thermal Motors, Inc., Ann Arbor, Mich.

[21] Appl. No.: 715,687

[22] Filed: Mar. 25, 1985

Related U.S. Application Data

[62] Division of Ser. No. 420,047, Sep. 20, 1982, Pat. No. 4,523,636.

[51] Int. Cl.[4] ..... F28D 19/00; F24H 3/12

[52] U.S. Cl. ..... 165/47; 165/104.26; 165/901; 126/117

[58] Field of Search ..... 165/104.26, 47, DIG. 2, 165/901; 122/33; 126/117

[56] References Cited

U.S. PATENT DOCUMENTS

| | | | |
|---|---|---|---|
| 1,671,188 | 5/1928 | Gauss | 126/117 |
| 4,045,197 | 8/1977 | Tsai et al. | 165/47 |
| 4,084,376 | 4/1978 | Asselman et al. | 165/104.26 |

*Primary Examiner*—Albert W. Davis, Jr.
*Attorney, Agent, or Firm*—Stephenson and Boller

[57] ABSTRACT

An improved heat pipe comprising a duct having disposed at opposite ends thereof an evaporator with wick-lined hollow fins in the form of extended corrugations thereon, and operable to supply heat to the evaporator comprised of a gas combustor having an internal volume for containing the evaporator and combustion air for supply to a combustion chamber located therein; a wick capable of transporting liquid by capillary action lining substantially all internal surfaces of said heat pipe; an external heat sink operable to remove heat from the condenser; and a heat transport medium contained by said heat pipe. The evaporator is further comprised of a coarse porous material lining and completely filling the spaces within the hollow fins open to the evaporator for increased structural stiffness and ease of fabrication; and a porous mass completely filling the evaporator for increased compressive strength. The coarse porous material and the porous mass are sufficiently porous to allow vapor to flow through each with a minimum of obstruction.

2 Claims, 11 Drawing Figures

HEAT PIPE

CROSS REFERENCE TO RELATED APPLICATION

This application is a divisional of application Ser. No. 420,047 now U.S. Pat. No. 4,523,636 granted June 18, 1985 filed Sept. 20, 1982.

BACKGROUND OF THE INVENTION

The present invention pertains to heat pipes and more particularly to heat pipes utilizing extended surfaces on evaporator portions thereof to increase heat transport from an external heat source operable to supply heat thereto.

SUMMARY OF THE INVENTION

The improved heat pipe according to the present invention, is characterized by adding hollow fins in the form of wick-lined, extending corrugations to an evaporator portion of said heat pipe for increasing both the external and internal surface areas of the evaporator.

Heat pipes in general are comprised of a tube having an evaporator at one end and a condenser at an opposite end, with an external heat source operable to supply heat to the evaporator and an external heat sink operable to extract heat from the condenser. Substantially all internal surfaces of the heat pipe are lined with a wick comprised of a fine porous material. The wick must be capable of transporting and distributing liquid by capillary action. Finally, the heat pipe is filled with a quantity of heat transport medium.

During steady state operation liquid heat transport medium is evaporated in the evaporator by heat supplied thereto from the external heat source. Vaporous heat transport medium, now containing the latent heat of evaporation, flows through the tube from the evaporator to the condenser wherein the latent heat is given up for subsequent transfer to the external heat sink. The heat transport medium condenses upon rejection of the latent heat of evaporation and the condensate is collected by the wick. Once inside the wick, the heat transport medium is transported by capillary action and/or gravity through the duct from the condenser to the evaporator for another cycle.

The heat transport rates within the evaporator and condenser are substantially equal because heat losses therebetween are small as compared to the total heat being transported and can be considered negligible. Disregarding such negligible losses, the following expression is true:

$$Q = A_e q_e = A_c q_c$$

where $Q$ = total heat transport rate $A_e$ = Area of evaporator $q_e$ = Heat flux to evaporator $A_c$ = Area of condenser $q_c$ = Heat flux from condenser It follows for any given heat pipe configuration that if the total heat transport Q is increased by increasing the area $A_e$ of the evaporator while maintaining a constant heat flux $q_e$ thereto, then without increasing the condenser area $A_c$ the heat flux from the condenser $q_c$ must increase proportionately. This characteristic of heat pipes is known as heat flux transformation and such characteristic is useful for supplying a large amount of heat to a small area. An object of the present invention is to transform relatively low heat flux at the evaporator to high heat flux at the condenser by configuring the former to have a surface area larger than that of the latter. Hollow fins added to the evaporator facilitate substantial addition to its surface area with only an insignificant addition to its size.

A conventional type of fin that increases external surface area, but not internal surface area is of only limited usefulness when added to an evaporator portion of a heat pipe, because only a modest increase in heat input occurs. Further, temperature gradients will develop along the evaporator perpendicularly to the fins caused by the locally higher heat flux from the heat conduction through each fin, and such gradients can cause the heat pipe to operate at less than maximum efficiency because of a boiling limitation of the liquid heat transport medium within the wick. The boiling limitation is a heat flux limit for the rate of evaporation within the heat pipe. If the heat flux through the walls of the evaporator is increased, bubbles can form in the liquid within the wick thereby causing hot spots and obstruction to the flow of the liquid therethrough.

The result of this phenomenon is that normally desired conductive evaporation, i.e. conduction of heat through the liquid with subsequent evaporation of the liquid at the liquid-vapor interface, is replaced with reduced liquid flow due to bubbles in the wick and a high probability of burnout in the regions of higher heat flux near the fins. Conversely, reduction of heat flux to eliminate boiling within the wick results in the regions between the fins to be subject to less than required heat flux levels to sustain conductive evaporation thereby reducing the overall efficiency of the heat pipe.

Hollow fins in the form of extended corrugations added to the evaporator surfaces to increase heat input to the heat pipe, eliminate the problems encountered with conventional type fins. The thermal resistance through wall surfaces of an evaporator with hollow fins added thereto, is substantially equal at all points due to the feature of increasing internal as well as external surface areas of the evaporator. Therefore, with uniform temperature, the heat flux along the evaporator remains uniform, thereby eliminating any temperature gradients and further minimizing the probability of burnout due to boiling within the wick.

The major advantage gained by hollow fins over conventional type fins is the significant increase in heat that enters the evaporator. With a conventional fin, the heat supply to the evaporator is increased by the conduction of heat along the length of the fin and through the base thereof, to the surface area of the evaporator to which the fin is attached.

With a hollow fin, the heat supply to the evaporator is increased by enthalpy transfer along the fin rather than conduction. More particularly, heat input is increased proportionately with an increase in the surface area through which heat is being transferred. During steady state operation, along all internal surfaces of each hollow fin, the liquid heat transport medium is being evaporated. After evaporation the heat transport medium flows along the hollow fin and into the evaporator. Therefore, heat flux from the additional evaporator surface area rapidly passes by enthalpy transfer into the evaporator.

The heat pipe contains a quantity of a heat transport medium for transporting heat from the evaporator to the condenser as described above. Media ranging from cryogenic gases such as hydrogen to liquid metals such as sodium can be selected for use in a heat pipe depending, inter alia, on the operating temperature and heat flux desired. After the operating temperature and heat flux are selected, the operating pressure of the heat pipe for the heat transport medium used is determined to be the saturation pressure at the selected temperature. The saturation pressure may be less than or greater than the pressure of the environment outside of the heat pipe. Accordingly it is another object of the present invention to provide means to structurally stiffen the evaporator and hollow fins to prevent collapse in the event the heat pipe must operate at a pressure lower than the ambient.

The hollow fins are stiffened by attaching a coarse porous gauze capable of supporting compressive loads to the interior surfaces of the evaporator with the wick sandwiched therebetween. The thickness of the coarse gauze is approximately one half the width of the hollow fin such that after fabrication the volume between surfaces of the wick in each hollow fin is completely filled with the coarse gauze, thereby providing structural stiffness. Sufficient spacing between wires of the coarse gauze is required to minimize obstruction to the flow of vapor therethrough.

Another object of the present invention is easy, low cost fabrication of the hollow fins and is accomplished when the coarse gauze is combined with the hollow fin configuration. During fabrication, when a fin is folded, the gauze automatically defines the inside width of the fin to be twice the thickness of the coarse gauze added to twice the wick thickness. Further, since the coarse gauze completely occupies the volume enclosed by the fin, the design of a die for accomplishing fabrication is simplified.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
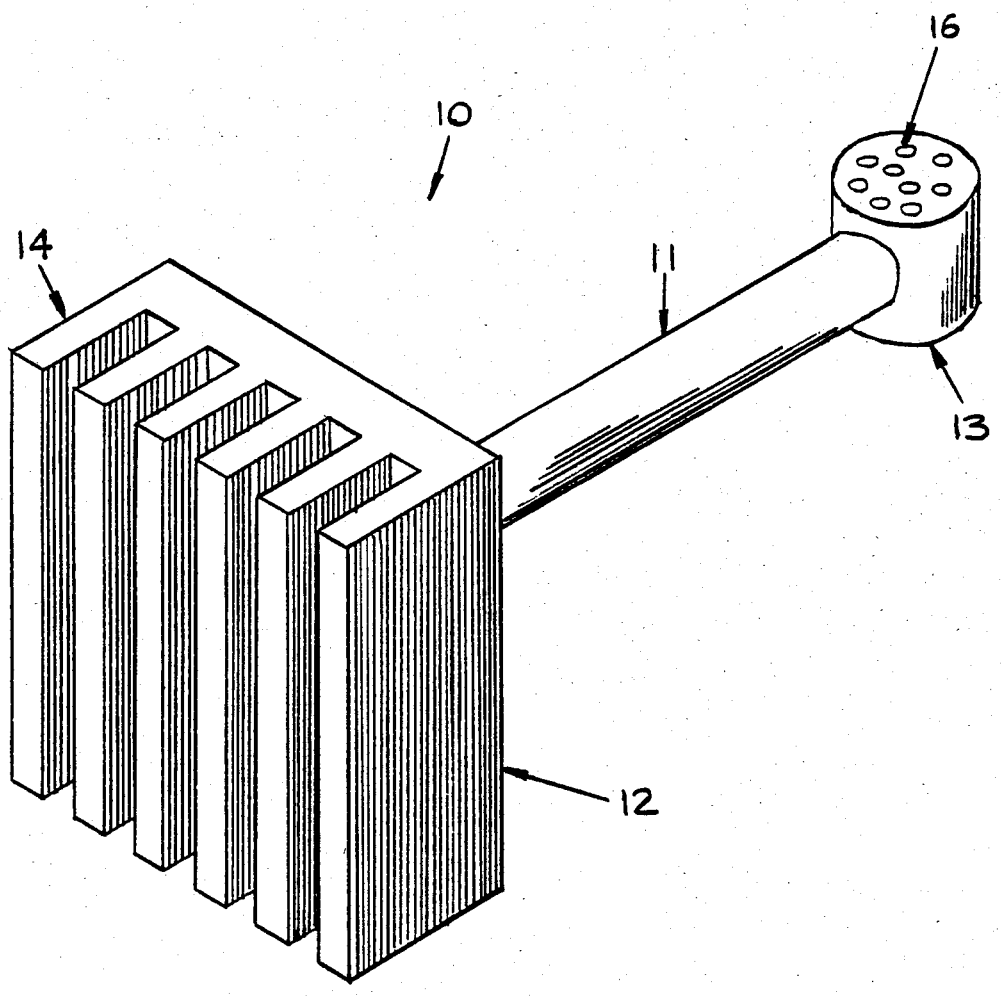
FIG. 1 is an overall pictorial view of the improved heat pipe showing hollow fins attached to the evaporator.
Figure 2:
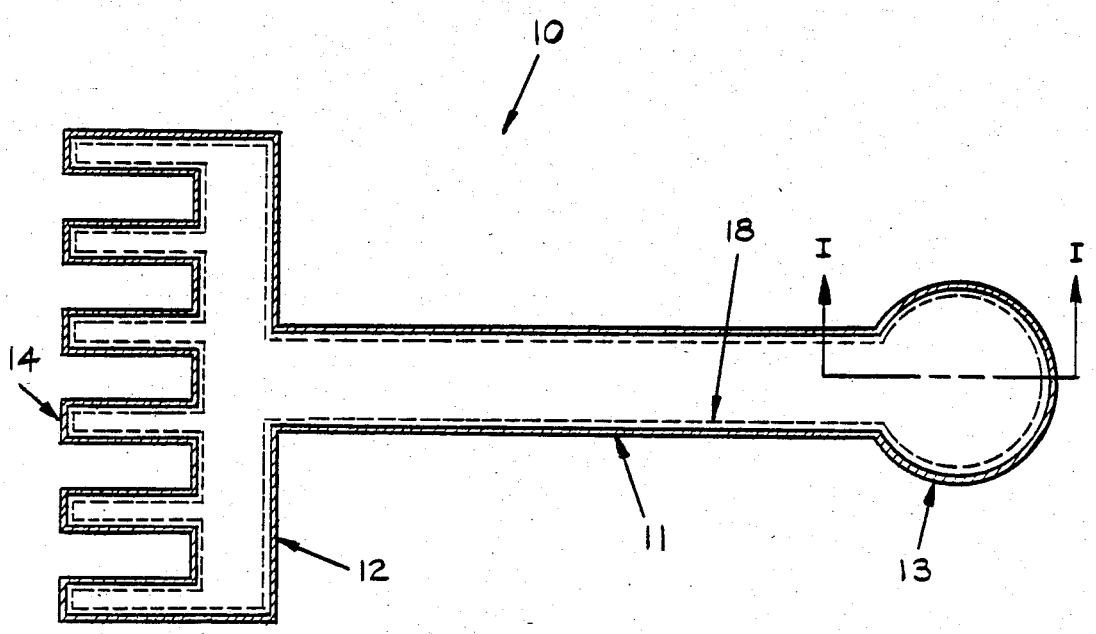
FIG. 2 shows an overall schematic longitudinal sectional view.

The improved heat pipe is shown in FIGS. 1 and 2 generally at reference numeral 10. More particularly, the heat pipe is comprised of a tube 11 having an evaporator 12 and a condenser 13 rigidly disposed at opposite ends. A plurality of substantially parallel extending hollow fins 14 in the form of wick-lined extending corrugations, are shown rigidly connected to evaporator 12.

Figure 3:
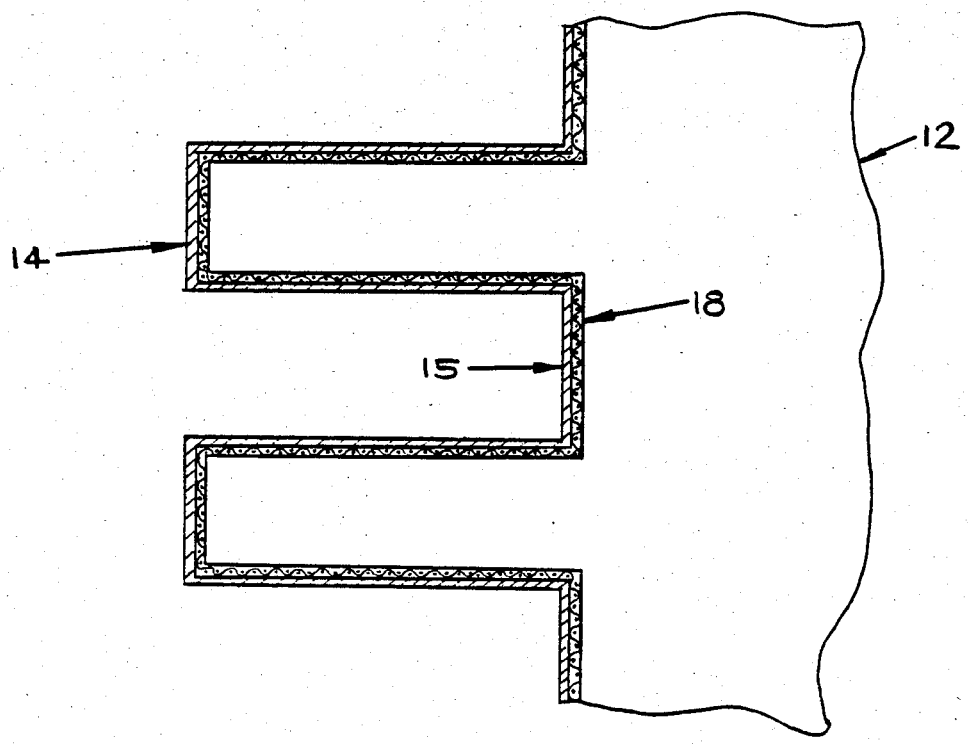
FIG. 3 is an enlarged, broken-out sectional view of hollow fins showing the wick therein.

FIG. 1 shows the hollow fins 14 to be oriented with the corrugations extending from the evaporator 12 surface substantially parallel to the tube 11. However, fin orientations perpendicular to the tube 11 or at other angles are possible to optimize heat transport in specific applications. Ends of the hollow fins 14 and the corresponding surfaces of the evaporator are sealed from the ambient by rigidly connected end plates. FIGS. 2 and 3 illustrate that the hollow fins 14 are rigidly attached to wall 15 of evaporator 12 and have surfaces which create spaces open to the evaporator 12 effectively increasing the external and internal surface areas thereof. The spaces within each hollow fin 14 open to evaporator 12 allow liquid and vaporous forms of a heat transport medium contained within heat pipe 10 to communicate between each space and evaporator 12.

Each hollow fin 14 has substantially parallel sides extending perpendicularly outward from the surface of evaporator 12. The parallel sides have base ends rigidly attached to the evaporator 12 and top ends which are connected by a top surface.

Figure 4:
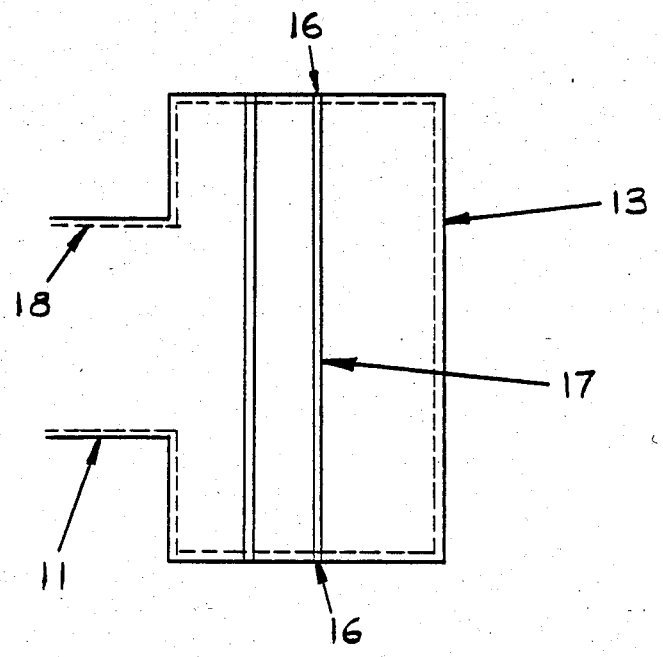
FIG. 4 is a schematic sectional view I—I of the condenser according to FIG. 2.

Condenser 13 is shown in FIGS. 1 and 4 to be a cylindrically shaped tube type heat exchanger oriented substantially perpendicularly to the tube 11. Through holes 16 are provided on the top and bottom surfaces of condenser 13. Heater tubes 17, located within condenser 13, are rigidly attached to the top and bottom surfaces thereof at through holes 16 for passing a fluid medium therethrough without mixing the fluid with the heat transport medium contained within heat pipe 10.

A wick 18 capable of transporting liquid with capillary action is attached to all internal surfaces of the evaporator 12 and tube 11, including the internal surfaces of each hollow fin 14, as FIGS. 2 and 3 illustrate. Most internal surfaces of condenser 13 are lined with wick 18, with a primary exceptions being the outer surfaces of heater tubes 17.

Figure 5:
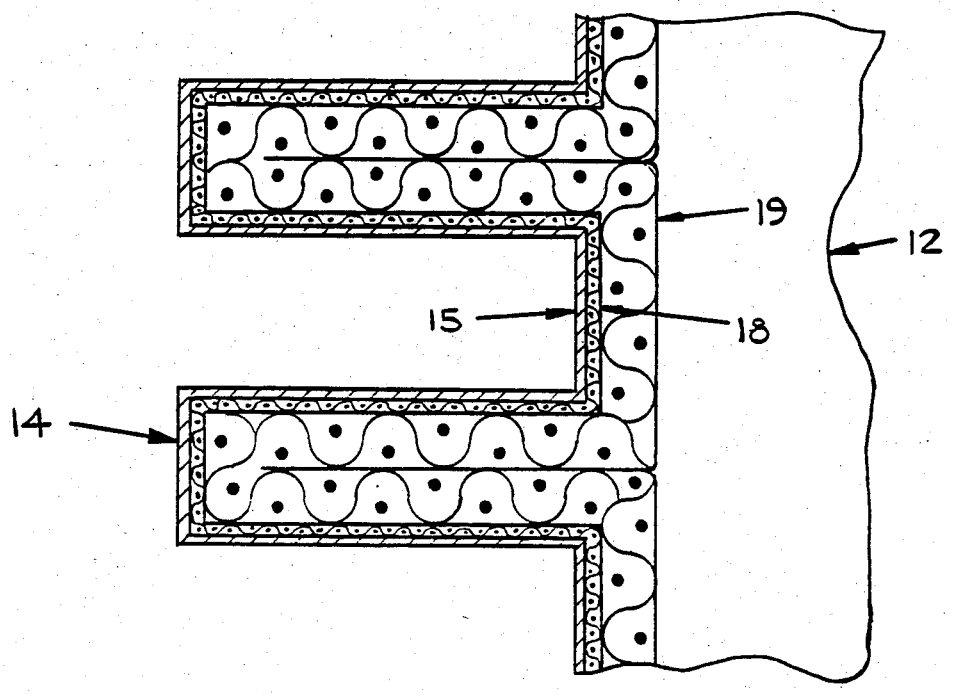
FIG. 5 is an enlarged, broken-out sectional view of hollow fins having coarse gauze therein.

FIG. 5 shows that a single layer of coarse, porous material 19 is attached to the evaporator 12 with the wick 18 sandwiched therebetween such that when the hollow fins 14 are fabricated, the coarse porous material 19 completely fills the space within each hollow fin 14, open to evaporator 12, Three advantages result from application of the layer of coarse gauze 19. First, easy, low cost fabrication is facilitated because the width of the space within each hollow fin 14, open to the evaporator 12, is determined as twice the thickness of coarse porous material 19 plus twice the thickness of wick 18. Second, the coarse porous material 19 urges wick 18 firmly against the wall of evaporator 12 to eliminate the gaps therebetween which adversely affect heat pipe operation. Finally, application of coarse porous material 19 provides stiffness for the hollow fins 14 to allow the heat pipe to operate at vacuum pressures without collapse. The coarse porous material 19 can be comprised of stainless steel gauze or other materials sufficiently porous to allow vaporous heat transport medium to flow therethrough with a minimum of obstruction to flow while providing compressive strength.

Figure 6:
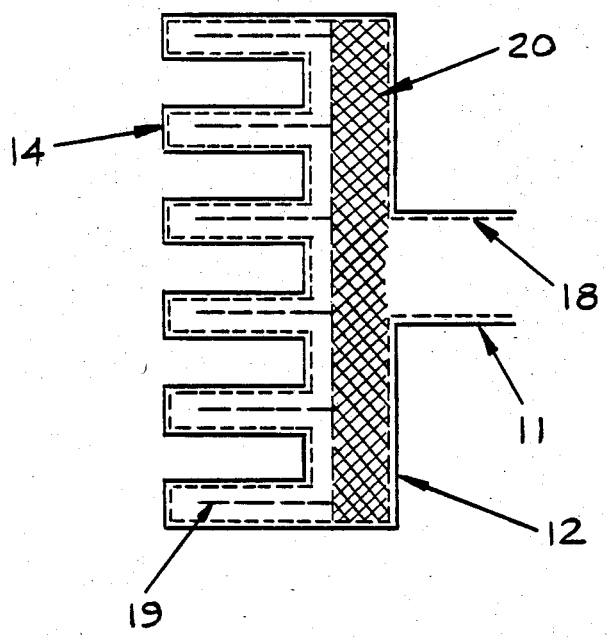
FIG. 6 is a partial longitudinal schematic sectional view of the evaporator showing a porous mass located therein.
Figure 7:
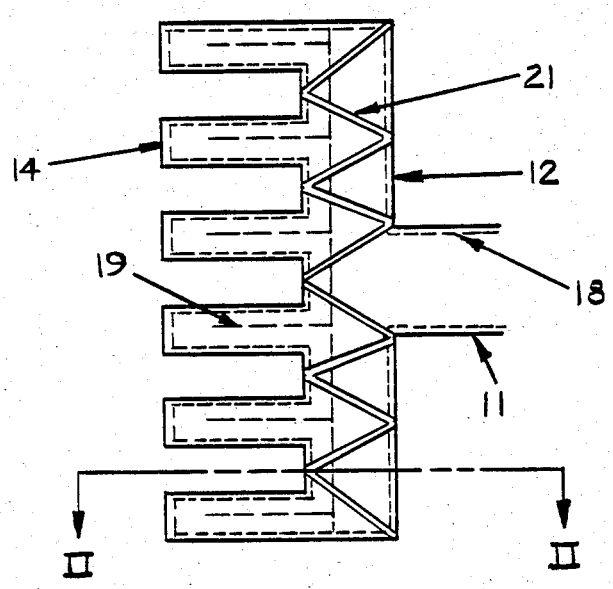
FIG. 7 is a partial longitudinal schematic sectional view of the evaporator showing an array of structural members located therein.
Figure 8:
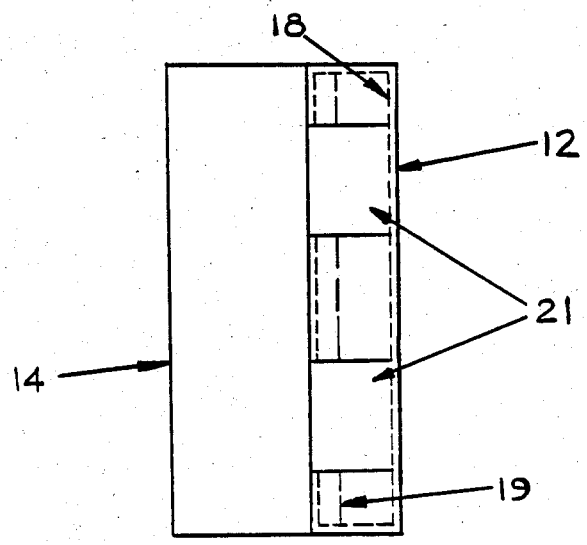
FIG. 8 is a sectional view II—II according to FIG. 7.

FIGS. 5 and 7 show means capable of supporting compressive load inserted into evaporator 12 for preventing collapse during operation of the heat pipe at vacuum pressures. More particularly, FIG. 6 shows a porous mass 20 completely occupying the remaining internal volume of evaporator 12 after installation therein of wick 18 and coarse porous material 19. The porosity of mass 20 is sufficient to allow vapor to flow therethrough with a minimum of pressure drop. Porous mass 20 can be comprised of, for example, stainless steel gauze or other woven material sufficiently porous to allow vaporous heat transport medium to flow therethrough with a minimum of obstruction to flow. Other means capable of supporting compressive load for preventing collapse of the evaporator during operation of the heat pipe, such as structural members 21 extending between opposite internal surfaces of walls of evaporator 12 and rigidly attached thereto, as shown in FIG. 7 can be used. FIG. 8 shows that the structural members 21 are spaced to provide substantially unrestricted flow of vaporous heat transport medium through the evaporator 12. Such members 21 can be angularly disposed as shown or disposed in any appropriate configuration to prevent collapse of evaporator 12 during operation of the heat pipe at vacuum pressures. Internally extending structural members 21 can also be rigidly attached to the walls of evaporator 12 to support tensile load in the event that the heat pipe is to operate at a pressure greater than the surrounding ambient.

Heat is supplied to the evaporator by an external heat source operable therefor. In general, a heat source can supply heat to the evaporator by conduction, convection, radiation or by combinations of these heat transfer methods depending on the type of fuel used, the design of the heat source and the temperature required. For example, for a sodium heat pipe, a combustor fired by gas or oil providing temperatures of 800° C. to 1000° C. may be typical.

Figure 9:
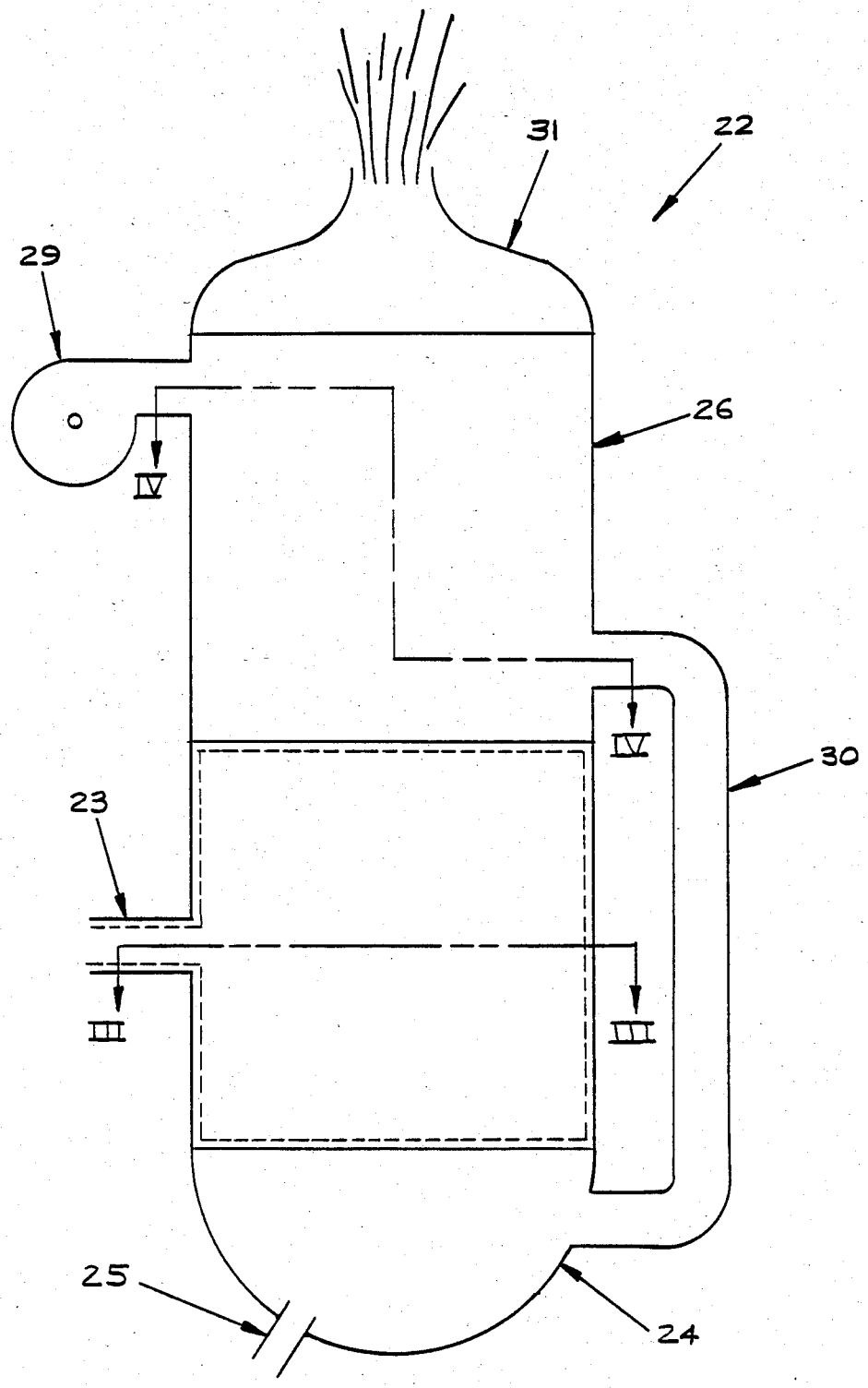
FIG. 9 is an overall schematic view of a gas or oil fired combustor.
Figure 10:
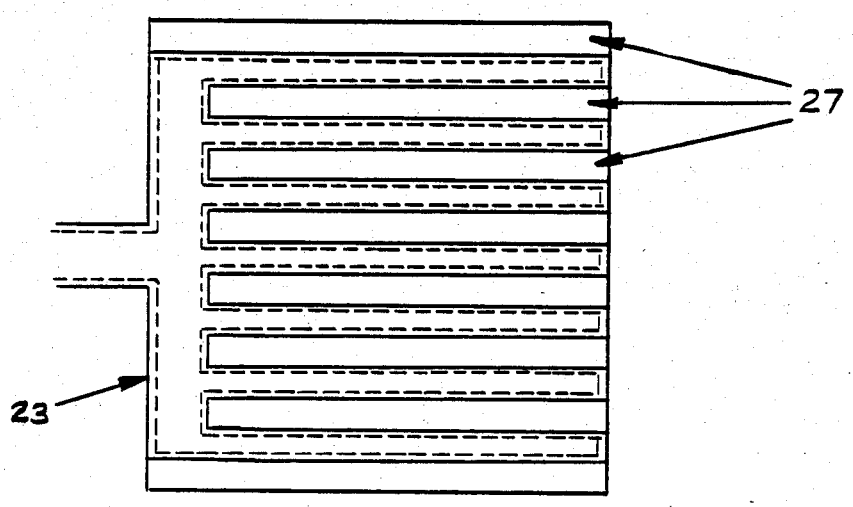
FIG. 10 is a sectional view III—III according to FIG. 9 showing the evaporator portion of an improved heat pipe within the combustor.
Figure 11:
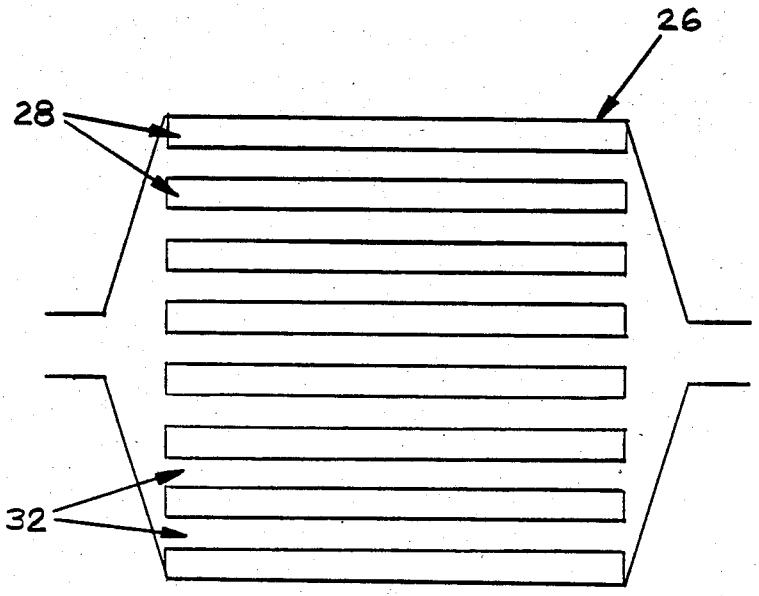
FIG. 11 is an offset sectional view IV—IV according to FIG. 9 showing the heat exchanger portion of the combustor.

An advantage of the instant invention is to provide larger external and internal evaporator surface areas for increasing the heat input therethrough to the heat pipe while not increasing the heat flux on the evaporator surface. This advantage is particularly useful in combination with heat sources that provide heat primarily by convection, for example, a gas or oil fired combustor. A typical combustor of this type generally includes a combustion chamber supplied with fuel and air preheated by the products of the combustion process, and means for disposing of the products of combustion, such as a stack. The evaporator portion of the heat pipe having wick lined hollow fins is disposed in the internal volume of the combustor such that the heat contained therein contacts all finned surfaces of the evaporator to maximize heat input thereto. More particularly, FIGS. 9, 10 and 11 show a gas fired combustor 22 having rigid wall surfaces that define an interior volume. Heat pipe 23, having an evaporator portion with wick lined hollow finned surfaces and a tube, is rigidly disposed with the evaporator portion thereof located within the interior volume of combustor 22 and the duct extending through the wall surface thereof. A combustion chamber 24 is located in the bottom of the interior volume, below the evaporator portion of heat pipe 23, and provides even heating thereto. Fuel nozzle 25 is rigidly connected to combustion chamber 24 and provides fuel thereto for combustion. A heat exchanger 26, also rigidly disposed within the internal volume, is located above the evaporator portion of heat pipe 23. Flow spaces 27 between the hollow fins on the evaporator portion of heat pipe 23 are open at the top and bottom and are aligned with first passages 28 within heat exchanger 26 also open at the top and bottom such that combustion gases can flow freely therethrough along a straight path, thereby to minimize obstruction to flow. Second passages 32 located within heat exchanger 26 are in closed thermal contact with first passages 28, are closed at the top and bottom and connected near the top to the blower 29 and near the bottom to duct 30 to prevent mixing of the ambient air with the products of the combustion process. A blower 29 is attached to the wall surface of combustor 22 near the top of heat exchanger 26. A duct 30 extends along the external surface of the wall of combustor 22 having a first end at the lower portion of heat exchanger 26 and a second end at the combustion chamber 24 for allowing air to pass therebetween. Each end is rigidly attached to the combustor 22 wall surface at an opening therein to facilitate the air flow. An exhaust stack 31 is rigidly attached to the top of combustor 22.

During operation, intake air at ambient conditions is drawn into blower 29 and forced into second passages 32 within heat exchanger 26 for preheating. Preheated air passes from heat exchanger 26 into duct 30 and flows therethrough to combustion chamber 24. Fuel enters the combustion chamber 24 through fuel nozzle 25 for subsequent combustion with the preheated air. As the hot combustion gases evenly flow between the hollow fins through flow spaces 27, heat is transferred therethrough to the heat transport medium enclosed within heat pipe 23. From flow spaces 27, the hot combustion gases pass through the first passages 28 within heat exchanger 26 for preheating the intake air flowing through second passages 32 in counterflow with respect to the hot combustion gases. Exhaust stack 31 provides an exit to atmosphere for the combustion gases.

Combustor 22 can be used with many types of heat pipes. For example, depending on the desired operating temperature and heat transport medium selected, the heat pipe may operate at pressures greater or less than the ambient temperature.

The evaporators shown in FIGS. 6 and 7 containing a coarse porous material 18 for strengthening hollow fins 14 and simplifying fabrication thereof and further containing porous mass 20 for structural strength can be used therewith. For each application, hollow fin parameters such as length, width, etc. can be varied to optimize heat pipe performance.

Alternate types of external heat sources can also be used to supply heat to a heat pipe evaporator having wick lined hollow fins thereon. Such other sources include fluidized bed heat sources whereby an evaporator is enclosed within an internal volume wherein an inert medium such as small silica particles are fluidized or supported by vertically upward flowing air. Fine coal particles are injected into the fluidized medium wherein combustion occurs thereby heating the evaporator. This method of heat supply provides efficient, even heat transfer to the evaporator and emissions from the combustion process generally contain low concentrations of carbon monoxide, oxides of nitrogen and sulfer dioxide.

In such application a heat exchanger substantially similar to the one described above will be placed above the evaporator to provide preheated air for combustion.

While the particular embodiments of the instant invention have been decribed and shown, it will be understood that many modifications may be made without departing from the spirit thereof, and it is contemplated by the appended claims to cover any such modifications as fall within the true spirit and scope of the instant invention.

What is claimed is:

1. In combination, means forming a housing, means providing a source of heat in said housing, a heat pipe including a duct having at opposing ends an evaporator and a condenser; said evaporator being located adjacent said heat source for receiving heat therefrom; a wick capable of transporting liquid with capillary action lining internal surfaces of said heat pipe; and a heat transport medium contained by said heat pipe for transporting heat between said evaporator and said condenser, hollow fins lined with said wick and with a lining of coarse porous material capable of supporting compressive load, thereby increasing structural stiffness of said fings, said fins having substantially flat parallel sides and being arranged in a generally parallel spaced relation with each other to enable heating of the interiors of said fins from said heat source passing heat through and by said flat sides thereof, and wherein spaces within said hollow fins open to said evaporator allow liquid and vaporous forms of said heat transfer medium to communicate therebetween, a heat exchanger positioned adjacent said evaporator for receiving heat from said heat source that has passed through said evaporator, and means for moving air for combustion for said heat source through said heat exchanger for pre-heating prior to supply to said heat source, said evaporator being positioned between said heat source and said heat exchanger with flow spaces aligned for allowing products of combustion to flow from said heat source through said evaporator and heat exchanger respectively along a straight path, thereby to minimize obstruction to flow.

2. Apparatus according to claim 1, further comprising duct means extending between said heat exchanger and said heat source for passing preheated air for combustion therebetween.

* * * * *